United States Patent [19]

Johnson

[11] Patent Number: 4,820,131

[45] Date of Patent: Apr. 11, 1989

[54] VENTURI NOZZLE ASSEMBLY CONSTRUCTION IN A SHALLOW WELL PUMP CASING

[75] Inventor: Charles S. Johnson, Fort Wayne, Ind.

[73] Assignee: Wayne/Scott Fetzer Company, Fort Wayne, Ind.

[21] Appl. No.: 92,155

[22] Filed: Sep. 2, 1987

[51] Int. Cl.[4] ..... F04B 23/04; F04B 39/12

[52] U.S. Cl. ..... 417/83; 417/89; 417/151; 417/195; 239/600; 138/109

[58] Field of Search ..... 417/79–84, 417/76, 87, 89, 151, 195, 196, 198; 239/600; 138/109, 44, 39; 285/370, 347, 330

[56] References Cited

U.S. PATENT DOCUMENTS

| | | | |
|---|---|---|---|
| 265,246 | 10/1882 | Conord | 417/198 |
| 297,880 | 4/1884 | Van Riper et al. | 285/330 X |
| 2,272,906 | 2/1942 | Da Col . | |
| 2,403,556 | 7/1946 | Ruth . | |
| 2,524,269 | 10/1950 | Patterson . | |
| 2,615,397 | 10/1952 | Conery . | |
| 2,700,338 | 1/1955 | Smith . | |
| 2,786,417 | 3/1957 | Lung . | |
| 2,853,014 | 9/1958 | Carpenter . | |
| 2,911,916 | 11/1959 | Bliss . | |
| 2,938,471 | 5/1960 | Jacuzzi et al. | 417/196 |
| 2,941,474 | 6/1960 | Hall . | |
| 2,987,002 | 6/1961 | Schipper . | |
| 3,018,799 | 1/1962 | Volkmann et al. | 138/44 X |
| 3,031,127 | 4/1962 | Duhaime et al. | 417/198 |
| 3,063,377 | 11/1962 | Stanley et al. . | |
| 3,291,051 | 12/1966 | Ekey | 417/83 X |
| 3,369,735 | 2/1968 | Hoffmeister | 417/195 X |
| 3,394,655 | 7/1968 | Brown | 417/89 X |
| 3,830,530 | 8/1974 | Glover | 285/347 X |
| 4,142,839 | 3/1979 | Davis et al. | 417/89 |
| 4,580,816 | 4/1986 | Campbell et al. | 285/347 X |
| 4,627,792 | 12/1986 | Jensen et al. . | |

*Primary Examiner*—Leonard E. Smith
*Assistant Examiner*—Robert Blackmon
*Attorney, Agent, or Firm*—George Pappas

[57] ABSTRACT

A shallow well centrifugal pump having a casing forming a fluid flow cavity and having a fluid intake end with a threadless bore and a suction inlet communicating with the cavity through the bore, and a diffuser disposed in the casing cavity and spaced from the casing intake end. The diffuser has a threadless opening defined therein leading to an impeller. A venturi nozzle assembly is supported in the casing cavity between the casing intake end and the diffuser. The assembly has threadless opposite end portions disposed in slidably removable slip fitted relation within the casing intake end and diffuser in the respective threadless bore and opening therein. Endless sealing elements preferably in the form of O-rings are fitted about the respective threadless opposite end portions of the venturi nozzle assembly for providing hermetic seals between the assembly opposite end portions and the casing intake end and the diffuser. The venturi nozzle assembly includes a supply and recirculation fluid intake conduit, a venturi tube and a nozzle which are preferably composed of plastic material and fabricated using injection molding techniques.

13 Claims, 3 Drawing Sheets

VENTURI NOZZLE ASSEMBLY CONSTRUCTION IN A SHALLOW WELL PUMP CASING

BACKGROUND OF THE INVENTION

The present invention generally relates to shallow well centrifugal pumps and, more particularly, is concerned with a unique venturi nozzle assembly construction in a shallow well pump casing.

Centrifugal or impeller type pumps are widely used in pumping systems, particularly in well pumping systems. The pumps used in well pumping systems are generally of two types, shallow well pumps and deep well pumps. The shallow well type pump is commonly used with wells having a depth from ground surface to water surface of about 25 feet or less and is typically located on the ground surface. Only a water intake or suction pipe to the pump extends into the well to below the water surface.

Representative pumps proposed in the prior art for use in wells and other applications are the ones disclosed in U.S. Pats. Nos. to Da Col (2,272,906), Ruth (2,403,556), Patterson (2,524,269), Conery (2,615,397), Smith (2,700,338), Lung (2,786,417), Carpenter (2,853,014), Bliss (2,911,916), Hall (2,941,474), Schipper (2,987,002), Stanley et al. (3,063,377) and Jensen et al. (4,627,792). A typical construction of a shallow well centrifugal pump is disclosed in the Ruth patent. The pump basically includes an electric motor, a housing or casing having a water suction inlet and discharge outlet, an impeller, a diffuser, and an arrangement of a venturi tube and nozzle. The diffuser is supported stationarily in the casing adjacent its discharge outlet. The impeller, which is rotatably driven by the motor, is disposed within the diffuser. The venturi tube and nozzle arrangement extends between and is mounted to the casing suction inlet and to the diffuser inlet which communicates with the center of the impeller. The venturi tube is disposed to receive water supplied from the well, via the suction pipe, through the suction inlet of the casing and water which is recirculated from the impeller, via the casing, through the nozzle. The combined action of high velocity rotation of the impeller and high pressure recirculation of a fraction of its water output via the casing through the nozzle to the venturi tube produces a vacuum condition at the suction inlet of the casing that then allows atmospheric pressure to supply or push water through the suction pipe from the bottom of the shallow well to the casing suction inlet and feed water therefrom through the venturi tube to the impeller inlet and out through the discharge outlet.

For the most part, historically, shallow well centrifugal pumps of the above-described typical construction have operated reasonably well and have generally achieved the level of performance for which they were designed. However, pumps of this general construction have certain drawbacks which make them less than an optimum design. One drawback is that the pump casing and a tube which supports the nozzle are frequently fabricated as a one-piece casting which requires slow, complicated and expensive fabrication steps. Another typical drawback is that the venturi tube and nozzle are oftentimes mounted to the casing and/or the diffuser by being threadably attached thereto. Provision of the threads necessary to accomplish attachment in this manner may further require additional time-consuming and expensive steps to be carried out to produce screw threads on the venturi tube, nozzle, casing and diffuser.

Still another drawback is that threaded connections make it difficult to properly locate certain components, such as the venturi tube and nozzle, relative to one another. As can be appreciated, this can be critical to the performance of the pump. Yet another time-consuming drawback is that threaded connections require the use of tools for assembly and disassembly of the components. A further drawback is that threaded connections can accumulate and hide foreign matter and prevent components from fitting together to their proper relative locations. Finally, screw threads do not always seal properly and cross-threading can easily occur between threads of plastic components and those of cast metal components.

Consequently, in view of the representative foregoing described drawbacks, it is readily apparent that a need still remains for many improvements in shallow well centrifugal pump construction.

SUMMARY OF THE INVENTION

The present invention provides a shallow well pump construction designed to satisfy the aforementioned needs and overcome disadvantages associated therewith. The pump construction of the present invention provides a unique venturi nozzle assembly that allows a more simplified, streamlined and easier molded pump casing and diffuser, resulting in an enhancement of manufacturability of the pump, an improvement of its reliability and serviceability and a substantial reduction of its production cost.

More specifically, threaded connections are not used between the components of the venturi nozzle assembly nor between the assembly and the pump casing and diffuser. No tools are required for assembly and disassembly of the venturi nozzle assembly with and from the pump casing and diffuser. Instead, the opposite ends of the assembly slidably interfit with the pump casing and diffuser, and O-ring seals are used at the interfitting regions of the components to provide more positive and dependable sealing thereat. Elimination of threaded connections prevents the possibility of crossthreading between plastic and metal components and avoids the need for additional threading of components. Accordingly, the pump casing can be redesigned to have a less complicated configuration which allows molds for casting to be produced on automatic mold making equipment. Fabrication of the nozzle support tube, nozzle and venturi tube, such as by using injection molding techniques, as separate assemblable components, allows incorporation of features which facilitate assembling and attachment of the components together at closer tolerances. Reduction of tolerance buildup means that placement of the components relative to one another and to the pump casing and diffuser at the desired proper locations can be achieved more positively and yet in a less time-consuming and less expensive manner.

Accordingly, the present invention is directed to a pump construction including the combination of a casing forming a fluid flow cavity and having a fluid intake end with a threadless bore and a suction inlet communicating with the cavity through the bore; a support disposed in the casing cavity and spaced from the casing intake end, the support having a threadless opening defined therein; a venturi nozzle assembly supported in the casing cavity between the casing intake end and the support, the assembly having threadless opposite end portions disposed in slidably removable slip fitted relation within the casing intake end and support in the respective threadless bore and opening therein; and endless sealing elements fitted about the respective threadless opposite end portions of the venturi nozzle assembly and disposed between the respective assembly end portions and the casing intake end and support in the respective threadless bore and opening therein, the sealing elements providing hermetic seals between the assembly opposite end portions and the casing intake end and support.

More particularly, each of the threadless opposite end portions of the venturi nozzle assembly has a circumferential groove defined therein. Each of the endless sealing elements is an O-ring composed of yieldably resilient material. The O-rings are disposed in the respective circumferential grooves and project radially outward therefrom.

The present invention is also directed to the venturi nozzle assembly which includes: a supply and recirculation fluid intake conduit; a venturi tube; and, a nozzle. Preferably, the fluid intake conduit, the venturi tube and the nozzle are made of plastic material and fabricated by injection molding techniques.

The fluid intake conduit of the assembly includes a cylindrical intake tube and a generally elbow-shaped pipe disposed within the intake tube and extending in a generally transverse relation thereto. The intake tube of the conduit defines a supply fluid intake passageway therethrough and has opposite inner and outer threadless end portions with openings defined respectively thereat. A first annular seal-receiving seat is formed on the intake tube about the outer end portion thereof. Also, a side opening is defined in the intake tube at a location between its opposite inner and outer end portions.

The elbow-shaped pipe of the conduit defines a recirculation fluid intake passageway therethrough and has first and second cylindrical threadless ends with openings defined thereat and being oriented at approximately ninety degrees with respect to one another. At its first end, the pipe is integrally connected with the intake tube such that its first opening communicates with the side opening of the intake tube. At its second end, the pipe is disposed in concentric relation with the intake tube and spaced radially inward therefrom such that its second opening faces toward but is spaced from the inner end portion of the intake tube.

The venturi tube of the assembly has a hollow body which defines a supply and recirculation fluid transfer passageway therethrough. The venturi tube body has tandemly-disposed and integrally-connected outer cylindrical and inner frusto-conical portions and opposite outer and inner threadless end portions with openings defined respectively thereat. The inner threadless end portion of the body is defined on the inner frusto-conical portion thereof, whereas the outer threadless end portion of the body is defined on the outer cylindrical portion thereof. A cylindrical rim is formed on the inner end portion of the body and has an inside diameter greater than the inside diameter of the outer end portion thereof. The inside diameter of the cylindrical rim on the venturi tube body is also greater than the outside diameter of the inner end portion of the intake tube for receiving the inner end portion of the intake tube within the cylindrical rim in a slip fit relation preparatory for attachment of the intake tube and venturi tube together. Also, a second annular seal-receiving seat is formed on the venturi tube body about its outer end portion.

The nozzle of the assembly includes a hollow member defining a recirculation fluid injecting passageway therethrough. The nozzle hollow member has a tandemly-disposed and integrally-connected inner cylindrical base and outer frusto-conical nose portions and opposite inner and outer threadless ends with openings defined thereat. The inner threadless end of the member is defined on its inner cylindrical base portion, whereas the outer threadless end of the member is defined on its outer frusto-conical nose portion. Also, an outer cylindrical edge portion and an inner annular flange portion are defined in a tandem arrangement on the inner threadless end of the nozzle member. The outer edge portion has an outside diameter less than that of the inner flange portion and less than the inside diameter of the second end of the elbow-shaped pipe for receiving the outer edge portion of the nozzle member inner end within the pipe second end in a slip fit relation for attachment of the nozzle and pipe together.

More particularly, each of the first and second annular seal-receiving seats formed respectively on the intake tube outer end portion and venturi tube body outer end portion is a pair of axially-spaced annular rings defining a circumferential groove therebetween.

Still further, an aligning element in the form of an axially-extending bead is formed on the intake tube at its inner end portion, whereas an aligning element in the form of an axially-extending recess is formed on the venturi tube body rim at the inner end portion thereof. The bead and recess are matable with one another when the intake tube inner end portion is received at the proper radial orientation within the venturi tube body rim. Also, a locating element in the form of an annular rib is formed on the intake tube about its inner end portion, whereas a locating element in the form of an annular groove is formed on the venturi tube body rim about the inner end portion thereof. The rib and groove are matable with one another when the intake tube inner end portion is received at the proper axial location within the venturi tube body rim.

Another locating element in the form of an annular groove is formed on the elbow-shaped pipe about its second end, whereas still another locating element in the form of an annular rib is formed on the nozzle member about the inner end thereof. The groove and rib are matable with one another when the nozzle member inner end is received at the proper axial location within the pipe second end.

These and other advantages and attainments of the present invention and the manner of obtaining them will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings wherein.

DETAILED DESCRIPTION OF THE INVENTION

Figure 1:
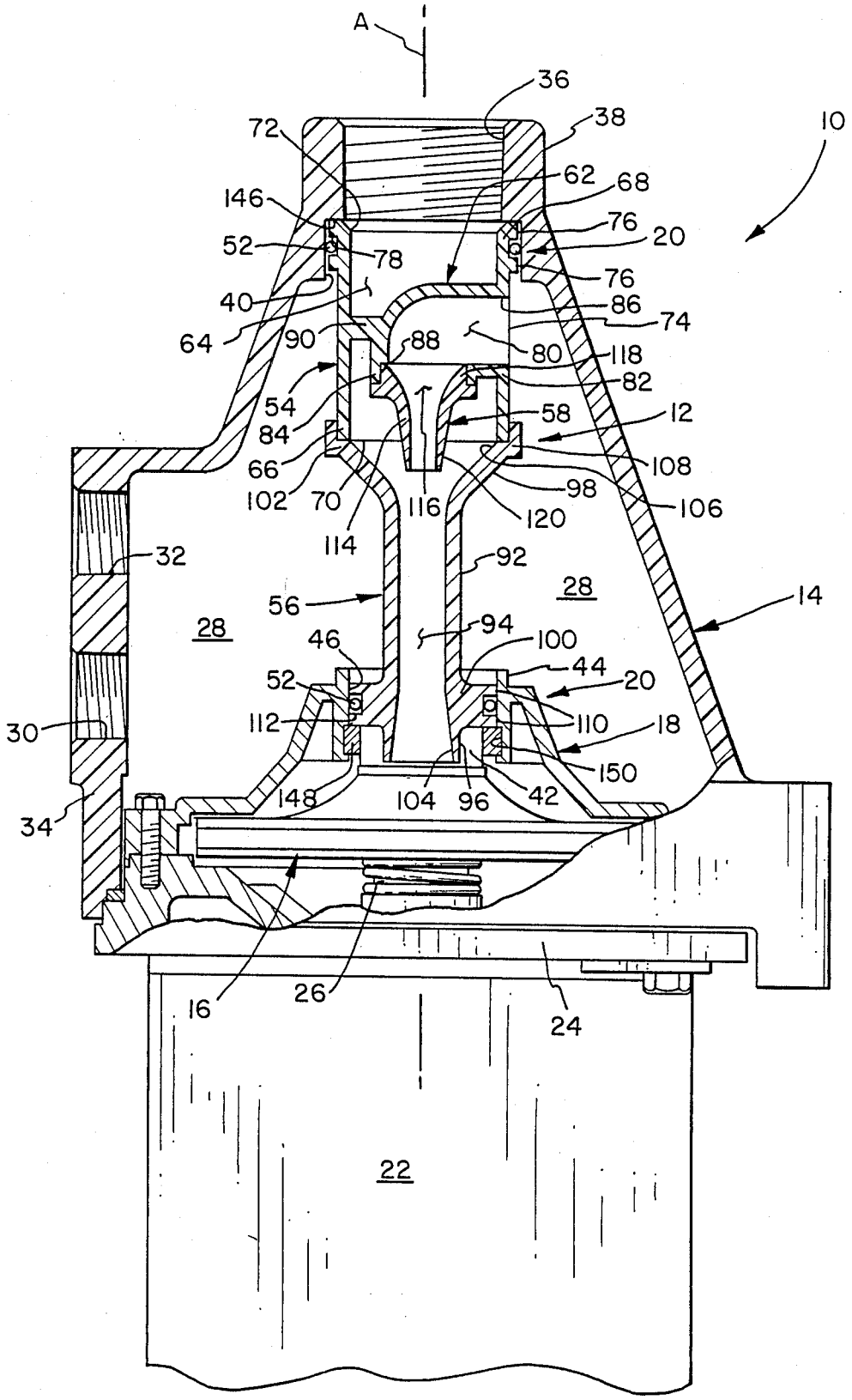
FIG. 1 is a side elevational view of a shallow well centrifugal pump shown partly in section and constructed in accordance with the present invention.

Referring now to the drawings, and particularly to FIG. 1, there is shown a shallow well centrifugal pump, generally designated by the numeral 10, incorporating a venturi nozzle assembly 12 and constructed in accordance with the principles of the present invention. In addition to the venturi nozzle assembly 12, the centrifugal pump 10 basically includes a casing 14, an impeller 16, a diffuser 18, and a sealing means generally designated as 20. Also, a power source, such as an electric motor 22, is provided for rotatably driving impeller 16. Casing 14 and diffuser 18 are attached to plate 24 which is part of motor 22. Impeller 16 is attached to the output shaft 26 of motor 22 for rotation at a high velocity upon operation of the motor.

More particularly, pump casing 14 is generally conical-shaped and forms a fluid flow cavity 28. Casing 14 has a discharge outlet 30 and a normally-closed pump priming opening 32 formed next to one another on a side 34 thereof. Casing 14 includes a suction inlet 36 on an intake end 38. Also, casing 14 has a central axis A and a threadless recessed cylindrical bore 40 aligned along the casing central axis A and disposed in flow communication with the casing suction inlet 36.

Figure 8:
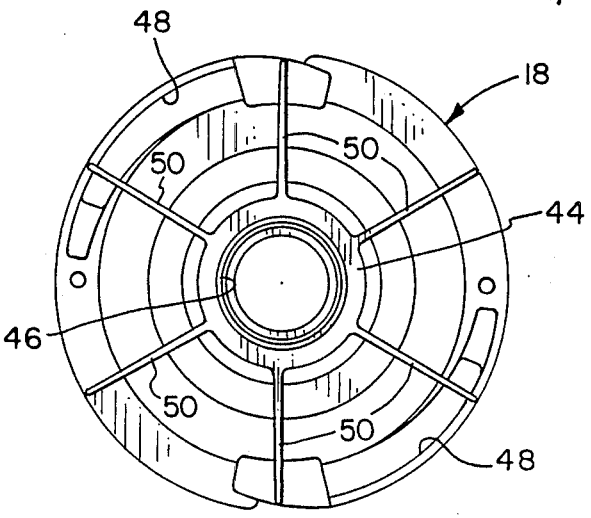

Impeller 16 and diffuser 18 are disposed side-by-side in the casing cavity 28 adjacent to discharge outlet 30 and spaced from suction inlet 36. Impeller 16 is rotatable about the central axis A of casing 14 and has a central inlet 42 aligned along the central axis A. Diffuser 18 is disposed adjacent to and between impeller 16 and discharge outlet 30 and, thus, the fluid output of impeller 16 must go through diffuser 18. As also seen in FIG. 8, diffuser 18 defines a threadless cylindrical opening 46 therethrough for allowing inflow of fluid to the impeller inlet 42. In addition, diffuser 18 has circumferentially spaced peripheral elongated openings 48 which direct outflow of fluid centrifugally propelled from the impeller 16 in swirling fashion within the casing cavity 28. Radially extending ribs 50 are integral with diffuser 18 and reinforce the same.

A portion of the fluid which is moving under high pressure in swirling fashion discharges through the casing outlet 30 and, a portion thereof is recirculated through the venturi nozzle assembly 12. The combined action of high velocity rotation of the impeller 16 and high pressure recirculation of a fraction of its fluid output via the casing cavity 28 through the venturi nozzle assembly 12 produces a vacuum condition at the casing suction inlet 36. The vacuum condition is sufficient to allow atmospheric pressure to supply or push fluid, such as water, through a suction pipe (not shown) which would be threadably attached to the suction inlet 36. The fluid can be drawn from a supply source, such as the bottom of a shallow well, to the casing suction inlet 36. The supply fluid and the recirculation intake fluid received through the venturi nozzle assembly 12 are thereafter drawn through inlet 42 of impeller 16.

As best shown in FIG. 1, venturi nozzle assembly 12 is disposed in the cavity 28 of casing 14 along its central axis and extends between the suction inlet 36 and the impeller 16. As will be described in detail below, assembly 12 has threadless opposite end portions supported in slidable removable slip fitted relation within the casing intake end 38 and the diffuser hub 44 respectively in the threadless recessed bore 40 in the casing intake end 38 and the threadless opening 46 in the diffuser hub 44. Further, as will become apparent below, assembly 12 has means defining a supply fluid intake passageway for providing flow communication from the casing suction inlet 36 to the impeller central inlet 42 and means defining a recirculation fluid passageway for providing flow communication from the casing cavity 28 to the supply fluid intake passageway. The sealing means 20 preferably include a pair of O-rings 52 composed of yieldably resilient material such as rubber. The sealing means 20 disposed about the opposite end portions of assembly 12 will also be described in detail below. The O-rings 52 provide threadless hermetic seals between the opposite end portions of the venturi nozzle assembly 12 and the casing intake end 38 and the diffuser hub 44 within the respective threadless recessed bore 40 and opening 46 thereof.

Figure 2:
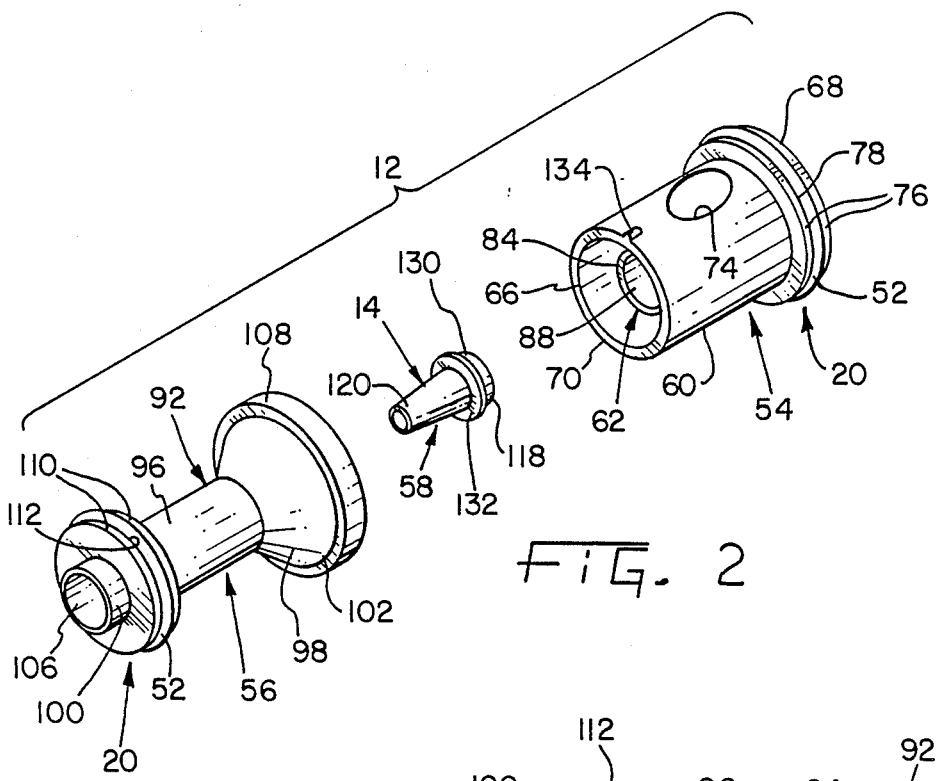
FIG. 2 is an exploded perspective view of a venturi nozzle assembly incorporated in the pump of FIG. 1.

As seen in assembled form in FIG. 1 and, unassembled exploded form in FIG. 2, the venturi nozzle assembly 12 includes a supply and recirculation fluid intake conduit 54, a venturi tube 56 and a nozzle 58. Preferably, the fluid intake conduit 54, venturi tube 56 and nozzle 58 are made of suitable plastic material, such as ABS T grade plastic, and fabricated separately by using conventional injection molding techniques. Casing 14 is preferably made of metal, such as iron, and fabricated by using conventional casting techniques. Casing 14 may also be made of plastic and fabricated by injection molding. Because no threaded connections are utilized in the pump 10 between the venturi nozzle assembly 12 and the casing 14, there is no possibility that crossthreading of plastic and metal threads can occur.

Figure 6:
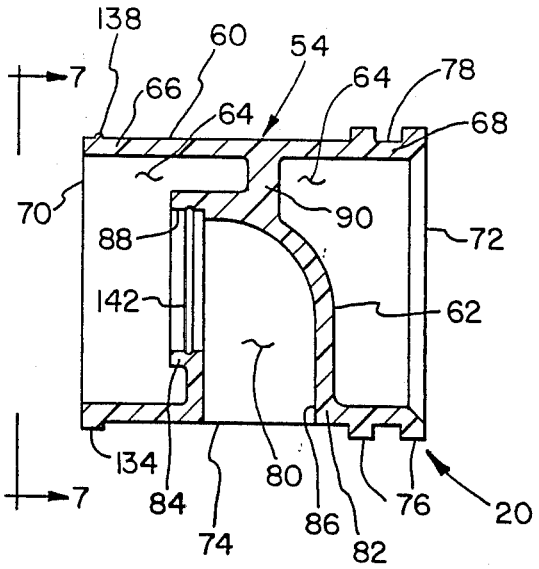
FIG. 6 is an enlarged longitudinal axial sectional view of a fluid intake conduit of the venturi nozzle assembly of FIG. 2.
Figure 7:
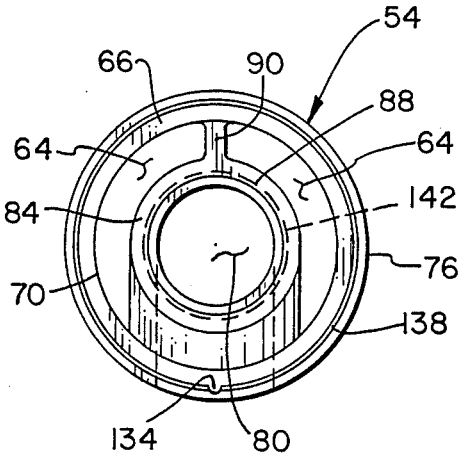
FIG. 7 is an end elevational view of the fluid intake conduit as seen along line 7—7 of FIG. 6; and, FIG. 8 is an end elevational view of a diffuser employed in the pump of FIG. 1 shown on a somewhat smaller scale.

More particularly, as shown in FIGS. 6 and 7 in addition to FIGS. 1 and 2, the supply and recirculation fluid intake conduit 54 includes a cylindrical intake tube 60 and a generally elbow-shaped pipe 62 disposed within the intake tube 60 and extending in a generally transverse relation thereto. The intake tube 60 defines therethrough the supply fluid intake passageway 64 of the assembly 12 and has opposite cylindrical inner and outer threadless end portions 66 and 68 which respectively define opposite end openings 70 and 72 in the tube 60. Also, a side opening 74 is defined in the intake tube 60 between interior and exterior surfaces thereof and at a location between its opposite inner and outer end portions 66 and 68.

In addition to the O-rings 52, the aforementioned sealing means 20 of pump 10 includes a first annular seal-receiving seat in the form of a pair of axially-spaced annular rings 76 formed on the intake tube 60 about the outer end portion 68 thereof. The spaced annular rings 76 extend radially outward from the exterior surface of the tube 60 and define a circumferential groove 78 therebetween in which is received one of the O-rings 52. The O-ring 52 has a diameter greater than the depth of the groove 78 so that the O-ring projects radially outwardly beyond the spaced annular rings 76. As the threadless outer end portion 68 of the tube 60 is inserted in a slip fitted relation within the threadless recessed bore 40 in the casing intake end 38, the one O-ring 52 seated in the groove 78 becomes compressed to provide a hermetic seal therebetween.

The elbow-shaped pipe 62 of the conduit 54 defines therethrough the recirculation fluid intake passageway 80 of assembly 12 and has opposite cylindrical first and second threadless ends 82 and 84 which respectively define opposite end openings 86 and 88 in the pipe 62 being oriented at approximately ninety degrees with respect to one another. At its first end 82, pipe 62 is integrally connected with the intake tube 60 such that its first end opening 82 communicates with the side opening 74 of the intake tube 60. At its second end 84, the pipe 62 is disposed in concentric relation with the intake tube 60 and spaced radially inwardly therefrom such that its second end opening 88 faces toward but is spaced from opening 70 of the inner end portion 66 of intake tube 60. A web 90 extends across the supply fluid intake passageway 64 and interconnects the intake tube 60 at its interior surface with the pipe 62 adjacent to its second end 84. The web 90 serves to reinforce pipe 62 within the intake tube 60 against forces imposed thereon from the pressurized flow of recirculated fluid through the pipe 62 and from supply fluid flowing through intake tube 60.

Figure 3:
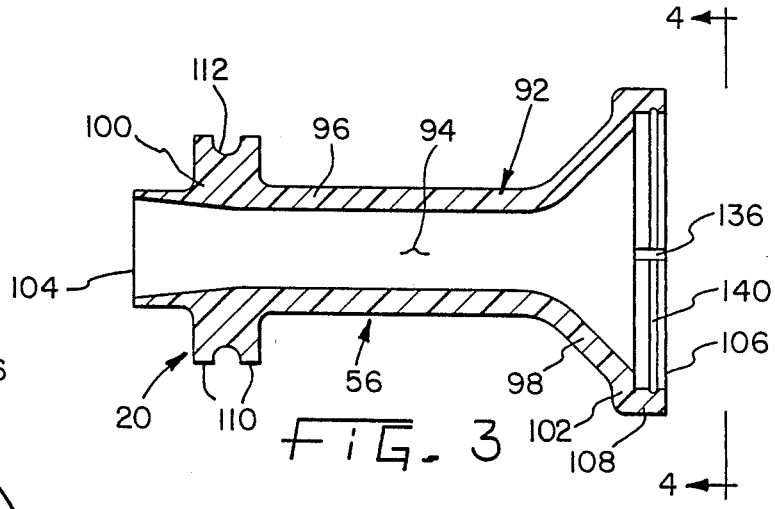
FIG. 3 is an enlarged longitudinal axial sectional view of a venturi tube of the venturi nozzle assembly of FIG. 2.
Figure 4:
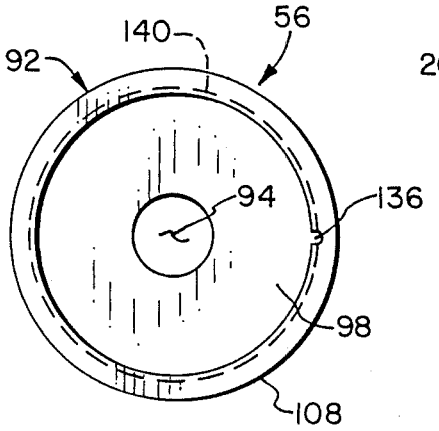
FIG. 4 is an end elevational view of the venturi tube as seen along line 4—4 of FIG. 3.

Turning now to FIGS. 3 and 4 in addition to FIGS. 1 and 2, there is seen the venturi tube 56 of assembly 12. Venturi tube 56 has a hollow body 92 which defines therethrough a supply and recirculation fluid transfer passageway 94 which receives supply fluid from intake passageway 64 and recirculating fluid injecting from passageway 80 through the pipe 62. The venturi tube body 92 has tandemly-disposed and integrally-connected outer substantially cylindrical and inner frusto-conical portions 96 and 98, and opposite outer and inner threadless end portions 100 and 102 which respectively define opposite end openings 104 and 106. The inner threadless end portion 102 of body 92 is defined on the inner frusto-conical portion 98 thereof, and the outer threadless end portion 100 is defined on the outer cylindrical portion 96 thereof.

A cylindrical rim 108 is formed on the inner threadless end portion 102 of the venturi tube body 92 and has an inside diameter greater than the inside diameter of the outer threadless end portion 100 thereof. The inside diameter of the cylindrical rim 108 of body 92 is also greater than the outside diameter of the inner threadless end portion 66 of intake tube 60 so that the inner end portion 66 of intake tube 60 can be inserted within the cylindrical rim 108 in a slip fitted relation preparatory for attachment of the intake tube 60 of the conduit 54 to venturi tube 56. A rigid attachment between the separate conduit 54 and venturi tube 56 can be made by adhering them together using a suitable adhesive or, alternatively, by bonding or welding them together using conventional ultrasonic energy techniques.

The aforementioned sealing means 20 of pump 10 includes a second annular seal-receiving seat in the form of another pair of axially-spaced annular rings 110 formed on the venturi tube body 92 about the outer end portion 100 thereof. The spaced annular rings 110 extend radially outward from the exterior surface of the venturi tube body 92 and define a circumferential groove 112 therebetween in which is received the other of the O-rings 52. The O-ring 52 has a diameter greater than the depth of groove 112 so as to project radially outwardly beyond the spaced annular rings 110. As the threadless outer end portion 100 of the venturi tube body 92 is inserted in a slip fitted relation within the threadless opening 46 in the diffuser hub 44, O-ring 52 seated in groove 112 becomes compressed to provide a hermetic seal therebetween.

Figure 5:
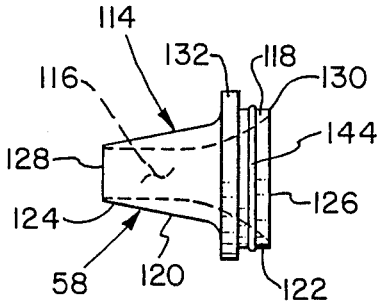
FIG. 5 is an enlarged side elevational view of a nozzle of the venturi nozzle assembly of FIG. 2.

Referring now to FIG. 5, in addition to FIGS. 1 and 2, there is shown nozzle 58 of the assembly 12. Nozzle 58 includes a hollow member 114 which defines therethrough a recirculation fluid injecting passageway 116 which receives fluid from passageway 80 through pipe 62. The nozzle hollow member 114 has tandemly-disposed and integrally-connected inner cylindrical base 118 and outer frusto-conical nose portion 120 and, further, includes opposite inner and outer threadless ends 122 and 124 which respectively define opposite end openings 126 and 128. The inner threadless end 122 of member 114 is defined on the inner cylindrical base portion 118, whereas the outer threadless end 124 of the member 114 is defined on the outer frusto-conical nose portion 120. The injection of fluid in a jet-like stream from nozzle 58 is enhanced due to the shape of the passageway 116 through the nozzle 58 as seen in FIGS. 1 and 5.

An outer cylindrical edge portion 130 and an inner annular flange portion 132 are defined in a tandem arrangement on the inner threadless end 122 of nozzle member 114. The outer edge portion 130 has an outside diameter less than that of the inner flange portion 132 and less than the inside diameter of the second end 84 of pipe 62 thereby allowing insertion of the outer edge portion 130 of the nozzle member inner end 122 within the pipe 62 second end 84 (until the latter abuts against the flange portion 132 of the nozzle) in a slip fit relation preparatory for attachment of the nozzle 58 and pipe 62 together. The provision of a rigid attachment between the separate nozzle 58 and conduit pipe 62 can be made in the same fashion as between the conduit intake pipe 60 and the venturi tube 56 by adhering them together using a suitable adhesive or, alternatively, by bonding or welding them together using conventional ultrasonic energy techniques.

Still further features are provided on the separately fabricated components—the intake conduit 54, venturi tube 56 and nozzle 58—of the assembly 12 to facilitate their accurate placement together prior to rigidly attaching them together. An aligning element in the form of a short axially-extending bead 134 is formed on the exterior surface of the intake tube 60 at its inner threadless end portion 66, whereas an aligning element in the form of a short axially-extending recess 136 is formed on the interior surface of the venturi tube body rim 108 at the inner threadless end portion 102 thereof. The bead 134 and recess 136 mate with one another when the intake tube inner end portion 66 is received at the proper radial or circumferential orientation within the venturi tube body rim 108.

Also, a locating element in the form of an annular rib 138 is formed on the exterior surface of the intake tube 60 about its inner threadless end portion 66, whereas a locating element in the form of an annular groove 140 is formed on the interior surface of the venturi body rim 108 about the inner end portion 102 thereof. The rib 138 and groove 140 mate with one another when the intake tube inner end portion 66 is received at the proper axial location within the venturi tube body rim 108. On the intake tube 60, the bead 134 intersects the annular rib 138 and is greater in height than the rib. On the venturi tube body 92, the recess 136 intersects the annular groove 140 and is greater in depth than the groove.

Another locating element in the form of an annular groove 142 is formed on pipe 62 about its second threadless end 84, whereas still another locating element in the form of an annular rib 144 is formed on the nozzle member 114 about the inner threadless end 122 thereof. Groove 142 and rib 144 mate with one another when the nozzle member inner end 122 is received at the proper axial location within the pipe second end 84.

Referring now, more particularly to FIG. 1, after intake conduit 54, venturi tube 56 and nozzle 58 are rigidly attached together to form assembly 12 and O-rings 52 are placed within respective grooves 78 and 112, assembly 12 is placed in its operating position by first inserting the threadless outer end portion 100 of venturi tube body 92 within threadless opening 46 of diffuser hub 44. Thereafter, casing 14 is attached to plate 24 by simultaneously allowing the threadless outer end portion 68 of tube 60 to be received within bore 40 in the casing intake end 38. To facilitate the proper axial placement of assembly 12 between diffuser 18 and the intake end 38 of casing 14, seat 146 is provided on intake end 38 of casing 14 and having a face substantially perpendicular to cylindrical bore 40. Outer threadless end portion 68 of intake tube 60 rests against seat 146. At the other end of assembly 12 thereof, a ring 148, preferably made of brass, is received within annular recess 150 located within recessed bore 44 of diffuser hub 44. Ring 148 provides a stop for end portion 100 of venturi tube body 92 and assembly 12 thereby axially properly locating assembly 12 and, further, preventing assembly 12 from being pulled further toward impeller 16 during operation. As can be appreciated, the foregoing described construction of venturi nozzle assembly 12 within pump 10 provides for substantially accurate placement of assembly 12 within pump 10 in substantially less assembly time and, further, at a substantially reduced cost.

While the invention has been described as having specific embodiments, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A venturi nozzle assembly in a centrifugal pump casing, said assembly comprising:

a supply and recirculation fluid cylindrical intake tube defining a supply fluid intake passageway therethrough and having opposite inner and outer threadless end portions with openings defined respectively thereat, a first annular seal-receiving seat formed on said intake tube about said outer end portion thereof, a side opening in said intake tube at a location between said opposite inner and outer end portions thereof, and a generally elbow-shaped pipe disposed within said intake tube and extending in a generally transverse relation thereto, said pipe defining a recirculation fluid intake passageway therethrough and having first and second cylindrical threadless ends with openings defined thereat and being oriented at approximately ninety degrees with respect to one another, said pipe at its first end being integrally connected with said intake tube and being disposed in communication with said side opening of said intake tube, said pipe at its second end being disposed in concentric relation with said intake tube and spaced radially inward therefrom and, at its second end opening, facing toward but spaced from said inner end portion of said intake tube;

a venturi tube having a hollow body defining a supply and recirculation fluid transfer passageway therethrough, said body having tandemly-disposed and integrally-connected outer substantially cylindrical and inner frusto-conical portions and opposite outer and inner threadless end portions with openings defined respectively thereat, said inner threadless end portion of said body being defined on said inner frusto-conical portion thereof and said outer threadless end portion of said body being defined on said outer cylindrical portion thereof, a cylindrical rim formed on said inner end portion of said body and having an inside diameter greater than the inside diameter of said outer end portion thereof and greater than the outside diameter of said inner end portion of said intake tube for receiving said inner end portion of said intake tube within said cylindrical rim in a slip fit relation for attachment of said intake tube and venturi tube together, and a second annular seal-receiving seat formed on said exterior surface of said body about said outer end portion thereof; and, a nozzle having a hollow member defining a recirculation fluid injecting passageway therethrough, said member having tandemly-disposed and integrally-connected inner cylindrical base and outer frusto-conical nose portions and opposite inner and outer threadless ends with openings defined thereat, said inner threadless end of said member being defined on said inner cylindrical base portion thereof and said outer threadless end of said member being defined on said outer frusto-conical nose portion thereof, and an outer cylindrical edge portion and an inner annular flange portion defined in a tandem arrangement on said inner threadless end of said member, said outer edge portion having an outside diameter less than the outside diameter of said inner flange portion and less than the inside diameter of said second end of said generally elbow-shaped pipe for receiving said outer edge portion of said inner end of said nozzle within said second end of said pipe in a slip fit relation for attachment of said nozzle and pipe together.

2. The assembly as recited in claim 1, wherein said first and second annular seal-receiving seats each are a pair of axially-spaced annular rings defining a circumferential groove therebetween.

3. The assembly as recited in claim 1, further comprising:

an axially extending bead formed on said intake tube at said inner end portion thereof;

an axially extending recess formed on said venturi tube body rim at said inner end portion thereof; and, wherein said axially-extending recess receives said bead when said venturi tube and intake tube are at the proper radial orientation and said intake tube is received within said venturi tube body rim.

4. The assembly as recited in claim 1, further comprising:

an annular rib formed on said intake tube about said inner end portion thereof;

an annular groove formed on said venturi tube body rim about said inner end portion thereof; and, wherein said annular groove receives said annular rib when said intake tube is received within said venturi body rim and said venturi tube and intake tube are at the proper axial location.

5. The assembly as recited in claim 1, further comprising:

an annular groove formed on said generally elbow-shaped pipe about said second end thereof;

an annular rib formed on said nozzle member about said inner end thereof; and, wherein said annular groove receives said annular rib when said nozzle member inner end is received within said pipe second end and said nozzle and pipe are at the proper axial location.

6. The assembly as recited in claim 1, wherein said intake conduit, said venturi tube and said nozzle are made of plastic material.

7. A centrifugal pump casing and venturi nozzle assembly comprising:

a casing forming a fluid flow cavity and having a fluid intake end with a threadless bore and a suction inlet communicating with said cavity through said bore;

a support disposed in said casing cavity and spaced from said casing intake end, said support having a threadless opening defined therein;

a venturi nozzle assembly supported in said casing cavity between said casing intake end and said support, said assembly having threadless opposite end portions disposed in slidably removable slip fitted relation within said casing intake end and support, in said respective threadless bore and opening therein; and endless sealing elements fitted about said respective threadless opposite end portions of said venturi nozzle assembly and disposed between said respective assembly end portions and said casing intake end and support in said respective threadless bore and opening therein, said sealing elements radially compressed between said respective assembly end portions and said casing threadless bore and threadless support opening and providing hermetic seals between said assembly opposite end portions and said casing intake end and support.

8. The pump as recited in claim 7, wherein each of said threadless opposite end portions of said venturi nozzle assembly has a circumferential groove defined therein, and each of said endless sealing elements is disposed in one of said circumferential grooves and projects radially outward therefrom.

9. The pump as recited in claim 8, wherein each of said endless sealing elements is an O-ring composed of yieldably resilient material.

10. The pump as recited in claim 7, wherein each of said threadless opposite end portions of said venturi nozzle assembly has a pair of axially-spaced annular rings formed thereon defining a circumferential groove therebetween, and wherein each of said endless sealing elements is a rubber O-ring disposed in a respective circumferential groove and projecting radially outward therefrom.

11. The pump as recited in claim 7, wherein said support is a diffuser disposed in said cavity of said casing, said diffuser having a central hub defining said threadless opening.

12. The pump as recited in claim 7 wherein said venturi nozzle assembly includes:

a supply and recirculation fluid cylindrical intake tube defining a supply fluid intake passageway therethrough and having opposite inner and outer threadless end portions with openings defined respectively thereat, a first annular seat formed on said intake tube about said outer end portion thereof for receiving one of said endless sealing elements, a side opening in said intake tube at a location between said opposite inner and outer end portions thereof, and a generally elbow-shaped pipe disposed within said intake tube and extending in a generally transverse relation thereto, said pipe defining a recirculation fluid intake passageway therethrough and having first and second cylindrical threadless ends with openings defined thereat and being oriented at approximately ninety degrees with respect to one another, said pipe at its first end being integrally connected with said intake tube and being disposed in communication with said side opening of said intake tube, said pipe at its second end being disposed in concentric relation with said intake tube and spaced radially inward therefrom and at its second end opening facing toward but spaced from said inner end portion of said intake tube;

a venturi tube having a hollow body defining a supply and recirculation fluid transfer passageway therethrough, said body having tandemly-disposed and integrally-connected outer substantially cylindrical and inner frusto-conical portions and opposite outer and inner threadless end portions with openings defined respectively thereat, said inner threadless end portion of said body being defined on said inner frusto-conical portion thereof and said outer threadless end portion of said body being defined on said outer cylindrical portion thereof, a cylindrical rim formed on said inner end portion of said body and having an inside diameter greater than the inside diameter of said outer end portion thereof and greater than the outside diameter of said inner end portion of said intake tube for receiving said inner end portion of said intake tube within said cylindrical rim in a slip fit relation, said intake tube and venturi tube being attached together, and a second annular seal-receiving seat formed on said exterior surface of said body about said outer end portion thereof for receiving the other of said endless sealing elements;

a nozzle having a hollow member defining a recirculation fluid injecting passageway therethrough, said member having tandemly-disposed and integrally-connected inner cylindrical base and outer frusto-conical nose portions and opposite inner and outer threadless ends with openings defined thereat, said inner threadless end of said member being defined on said inner cylindrical base portion thereof and said outer threadless end of said member being defined on said outer frusto-conical nose portion thereof, and an outer cylindrical edge portion and an inner annular flange portion defined in a tandem arrangement on said inner threadless end of said member, said outer edge portion having an outside diameter less than the outside diameter of said inner flange portion and less than the inside diameter of said second end of said generally elbow-shaped pipe said outer edge portion of said inner end of said nozzle being received within said second end of said pipe in a slip fit relation, said nozzle and pipe being attached together; and, wherein said outer threadless end portion of said intake tube is disposed in said threadless bore of said casing and said outer portion of said venturi tube is disposed within said opening of said support.

13. The pump as recited in claim 12 wherein said intake tube, venturi tube and nozzle are made of plastic material.

* * * * *